US010144116B2

(12) United States Patent
Bartl

(10) Patent No.: US 10,144,116 B2
(45) Date of Patent: Dec. 4, 2018

(54) CLAMPING DEVICE FOR CLAMPING A WORKPIECE AND PROCESSING TABLE WITH A CLAMPING DEVICE

(71) Applicant: Toni Bartl, Uffing am Staffelsee (DE)

(72) Inventor: Toni Bartl, Uffing am Staffelsee (DE)

( * ) Notice: Subject to any disclaimer, the term of this patent is extended or adjusted under 35 U.S.C. 154(b) by 554 days.

(21) Appl. No.: 14/754,182

(22) Filed: Jun. 29, 2015

(65) Prior Publication Data

US 2016/0121461 A1 May 5, 2016

(30) Foreign Application Priority Data

Apr. 30, 2014 (DE) ..... 10 2014 006 355

(51) Int. Cl.

| | |
|---|---|
| ***B25B 5/02*** | (2006.01) |
| ***B25B 5/16*** | (2006.01) |
| ***B25B 5/00*** | (2006.01) |
| ***B25B 5/10*** | (2006.01) |

(52) U.S. Cl.

CPC ..... *B25B 5/166* (2013.01); *B25B 5/006* (2013.01); *B25B 5/10* (2013.01); *B25B 5/102* (2013.01)

(58) Field of Classification Search

USPC ..... 269/45, 142, 207, 210, 249

See application file for complete search history.

(56) References Cited

U.S. PATENT DOCUMENTS 1,140,243 A 5/1915 Brimhall
3,740,048 A * 6/1973 Lassy ..... B23Q 1/28 188/67
6,148,881 A 11/2000 Valenzuela
8,276,895 B2 * 10/2012 Brown ..... B23K 37/0435 269/210
9,802,301 B2 * 10/2017 Caston ..... B25B 27/02

FOREIGN PATENT DOCUMENTS

| | | |
|---|---|---|
| CH | 682892 A | 12/1993 |
| DE | 7513254 U | 8/1975 |
| DE | 102009022013 A1 | 11/2010 |

* cited by examiner

*Primary Examiner* — Joseph J Hail

*Assistant Examiner* — Shantese McDonald

(74) *Attorney, Agent, or Firm* — Fitch, Even, Tabin & Flannery LLC

(57) ABSTRACT

The invention relates to a clamping device for clamping a workpiece, comprising a clamping element for clamping the workpiece; a rod having multiple radial slits disposed one behind the other in longitudinal direction of the rod, which each only extend along a partial circumferential area of the rod; a receiving device for receiving the clamping element and the rod; a longitudinal guide, within which the rod is disposed rotatably between a latching position and a release position; a locking mechanism disposed on the longitudinal guide, which does not engage with any of the radial slits in the release position such that the rod is movable in axial direction within the longitudinal guide, and engages with at least one of the radial slits in the latching position such that the rod is fixed in axial direction within the longitudinal guide. Furthermore, the invention relates to a processing table with a clamping device.

15 Claims, 6 Drawing Sheets

1
3
4
15
M
7
2.1
2
5
2.3
2.2
6

A
A
B
B
2
2.1
3
4
8
10
11
12
13

CLAMPING DEVICE FOR CLAMPING A WORKPIECE AND PROCESSING TABLE WITH A CLAMPING DEVICE

The present invention relates to a clamping device for clamping a workpiece as well as to a processing table with a clamping device.

Clamping devices are known in very different embodiments, such as for example quick-clamping mechanisms disposed on a processing table of a workbench, jaw vises and the like.

Partially, usual clamping devices have a relatively low variability with respect to the clamping possibilities for a workpiece. Further, the exactly fitting arrangement of such clamping devices with respect to a processing table and the latching on a processing table can become relatively complicated.

Therefore, it is the object of the present invention to provide a solution, by means of which a workpiece can be clamped in particularly simple and exact manner.

This object is solved by a clamping device having the features of claim 1 as well as by a processing table with a clamping device having the features of claim 15. Advantageous configurations with convenient and non-trivial developments of the invention are specified in the dependent claims.

The clamping device according to the invention for clamping a workpiece comprises a clamping element for clamping the workpiece and a rod having multiple radial slits disposed one behind the other in longitudinal direction of the rod, which each extend only along a partial circumferential area of the rod. Furthermore, the clamping device has a receiving device for receiving the clamping element and the rod. Moreover, the clamping device comprises a longitudinal guide, within which the rod is disposed rotatably between a latching position and a release position. In addition, the clamping device comprises a locking mechanism disposed on the longitudinal guide, which does not engage with any of the radial slits in the release position such that the rod is movable in axial direction within the longitudinal guide, and engages with at least one of the radial slits in the latching position such that the rod is fixed within the longitudinal guide in axial direction.

In other words, the rod thus has a flat circumferential area and a non-flat circumferential area. The non-flatness results from the fact that the non-flat circumferential area has multiple radial slits disposed one behind the other in longitudinal direction of the rod. The rod can be rotated between the release position and the latching position within the longitudinal guide. In the release position, the locking mechanism abuts the flat circumferential area of the rod such that the locking mechanism does not engage with any of the radial slits. In the release position, the rod can therefore be moved in axial direction within the longitudinal guide. Since the rod is coupled to the clamping element via the receiving device, thus, the clamping element can also be translationally moved relative to the longitudinal guide. In contrast, in the latching position, the locking mechanism abuts the non-flat circumferential area of the rod such that the locking mechanism engages with at least one of the radial slits. Thus, in the latching position, the rod can no longer be moved in axial direction within the longitudinal guide.

Thus, by means of the solution according to the invention, the clamping element can be adjusted and latched in translational direction via the rod in simple manner.

An advantageous embodiment of the invention provides that the receiving device has a first receiving bore, in which the rod is rotationally fixed received. Therein, it can be provided that the rod additionally is also axially displaceably received in the first receiving bore.

According to a further advantageous embodiment of the invention, it is provided that the receiving bore has a stud in the interior, which is guided in a longitudinal groove of the rod bounded at both ends.

In further advantageous configuration of the invention, it is provided that the receiving device has a second receiving bore, in which a guide rod of the clamping element is axially displaceably and rotatably receivable. Therein, it is preferably provided that the first receiving bore extends perpendicularly to the second receiving bore.

A further advantageous embodiment of the invention provides that the receiving device has a third receiving bore, in which the guide rod of the clamping element is axially displaceably and rotatably receivable. Therein, the first receiving bore extends parallel to the third receiving bore.

According to a further advantageous embodiment of the invention, it is provided that the longitudinal guide has a latching mechanism, by means of which the guide rod is fixable to the longitudinal guide.

According to a further advantageous embodiment of the invention, it is further provided that the locking mechanism has a spring element acting inwards in radial direction of the rod, which does not engage with any of the radial slits in the release position and engages with at least one of the radial slits in the latching position. Therein, the spring element preferably has a nose, which passes through a bore in the longitudinal guide and does not engage with any of the radial slits in the release position and engages with at least one of the radial slits in the latching position.

A further advantageous embodiment of the invention provides that the clamping device has a fixture serving as an abutment for the workpiece, which can be disposed on the rod.

In further advantageous configuration of the invention, it is provided that the receiving device has at least one supporting surface for the workpiece.

According to a further advantageous embodiment of the invention, it is provided that the longitudinal guide is fixable to a processing table, in particular on a bottom of the processing table.

The processing table according to the invention comprises the clamping device according to the invention or an advantageous embodiment of the clamping device according to the invention.

Accordingly, the invention proposes a clamping device for clamping a workpiece in the area of a processing table, wherein the clamping device is fixable to the processing table. It has at least one clamping element and a receiving device for the at least one clamping element, wherein the receiving device is configured such that it preferably allows four degrees of freedom with respect to the processing table for a movement of the clamping element.

Therein, the clamping device according to the invention is configured such that it can be subsequently overall fixed to a processing table, for example a workbench.

The receiving device for the at least one clamping element is configured as an angular element, which has three receiving bores for the clamping element, wherein at least two receiving bores cross each other in a right angle.

Preferably, the clamping element is formed as a screw clamp, wherein a guide rod for the manually operable clamping screw can be individually inserted into one of the receiving bores.

Moreover, the receiving device is configured such that it has at least one supporting surface for the workpiece, that is the receiving device itself can serve as an abutment for a workpiece clamped by the clamping device.

In a preferred embodiment, the receiving device designed as an angular element is displaceably guided on a rod, wherein the rod itself is displaceably guided with respect to the processing table. By a corresponding length of the rod, the extension range for the clamping device can be increased such that very wide workpieces can also be clamped laterally on the processing table. Alternatively, hereby, the area of the processing table can also be extended by clamping an extension area such that large-area workpieces can be subjected to different processing steps on the thus increased area of the processing table.

Moreover, the screw clamp can be inserted into the receiving bores of the receiving device from different directions. Thus, it is for example possible that the screw clamp is mounted such that the clamping screw is disposed oriented away from the supporting surface. In this manner, workpieces can be clamped freely to the outside such that they can be processed, for example sawed, in barrier-free manner.

DETAILED DESCRIPTION OF PREFERRED EMBODIMENTS

For the purpose of clamping, the clamping device has at least one locking mechanism, with the aid of which the rod can be latched in an individual position with respect to the processing table. Preferably, the locking mechanism is disposed below the processing table, in the proximity of which a latching mechanism is moreover provided, with the aid of which the clamping device can be completely stowed and fixed below the processing plate. In this manner, the entire clamping device can be stowed when it is no longer needed without constituting an obstacle for further processing steps on the processing table as it would for example be the case with clamping mechanisms or jaw vises etc. fixedly disposed on the processing table.

Further advantages and features of the present invention are apparent from the description of the embodiments illustrated based on the attached drawings. There show

Figure 1:
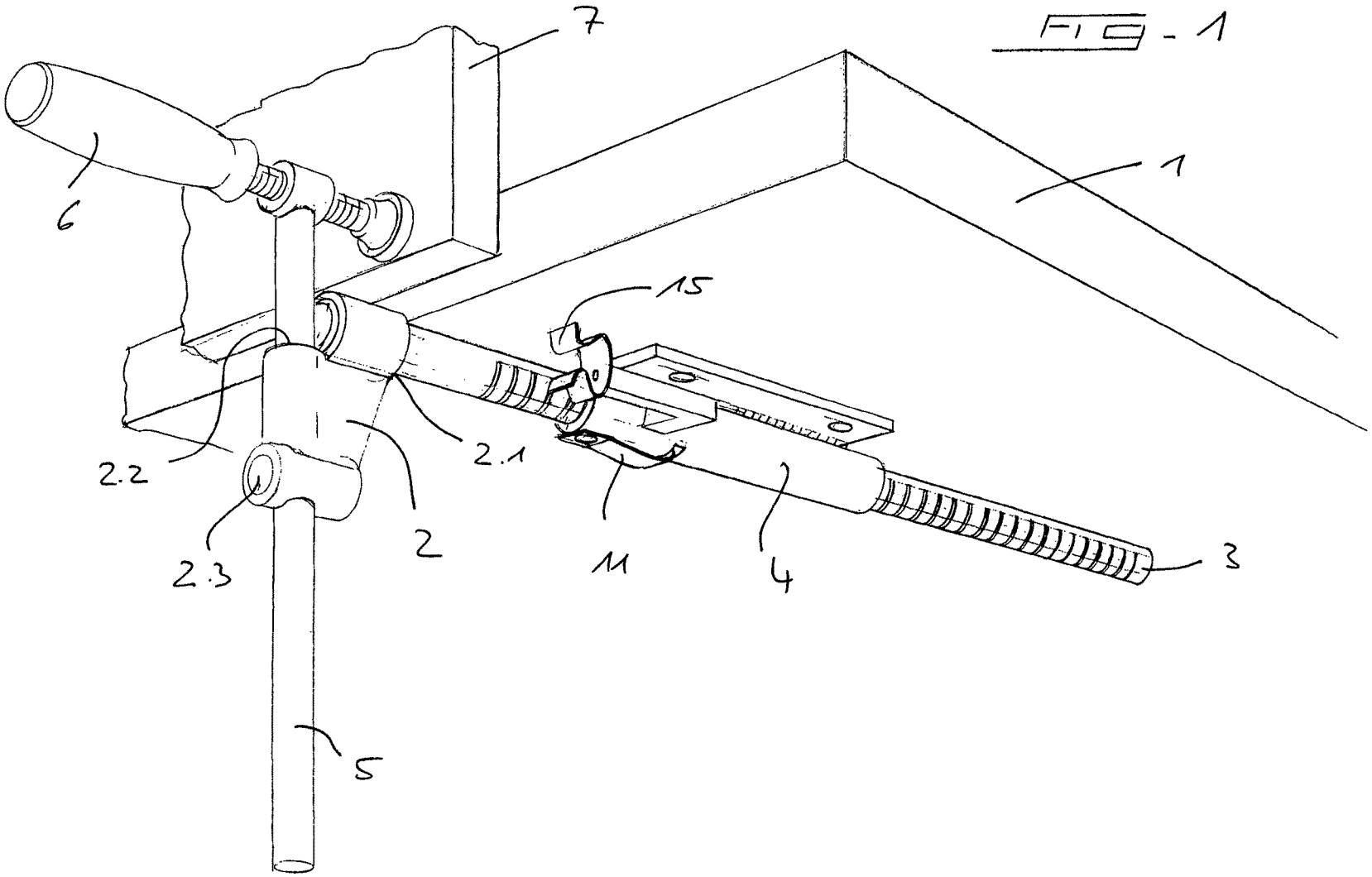
FIG. 1 a perspective view of a clamping device according to the invention, which is fixed to a processing table.
Figure 2:
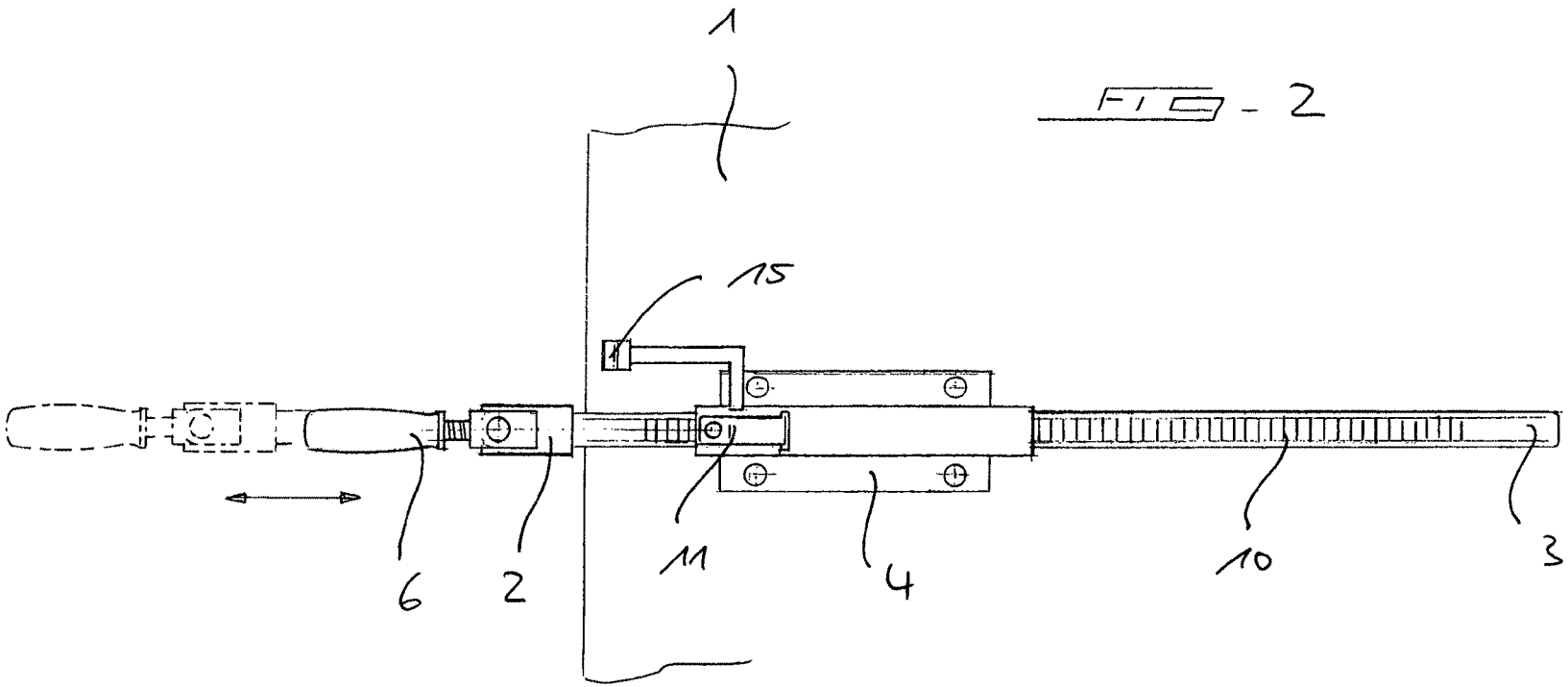
FIG. 2 the clamping device from below.

In the FIGS. 1 and 2, the clamping device according to the invention is schematically shown. It is disposed below a processing table 1 and has an angular receiving device 2, which has three receiving bores 2.1, 2.2 and 2.3.

A first receiving bore 2.1 serves for receiving a rod 3 such that the receiving device 2 is displaceably guided on the rod 3.

The rod 3 in turn is displaceably guided in a longitudinal guide 4, which is for example fixed to the bottom of the processing table 1 via corresponding flanges.

The second receiving bore 2.2 of the receiving device 2 serves for displaceably receiving the guide rod 5, at the one end of which a manually operable clamping screw 6 is received via a corresponding threaded connection, such that a workpiece 7 can be correspondingly clamped for example on the front side of the processing table 1 (see FIG. 1).

As is apparent from FIG. 2, the clamping device according to the invention is axially adjustable with respect to the processing table 1 in the longitudinal guide 4 via the guide of the rod 3, which provides a first degree of freedom.

In order to allow a corresponding abutment for clamping the workpiece 7 in an axial direction of the rod 3, as it is illustrated in FIG. 1, a locking mechanism is provided, with the aid of which the rod 3 can be latched with respect to the processing table 1.

This locking mechanism as well as its manner of operation becomes clear from FIGS. 3*a* to 3*d*.

Figures 3A, 3B, 3C, 3D:
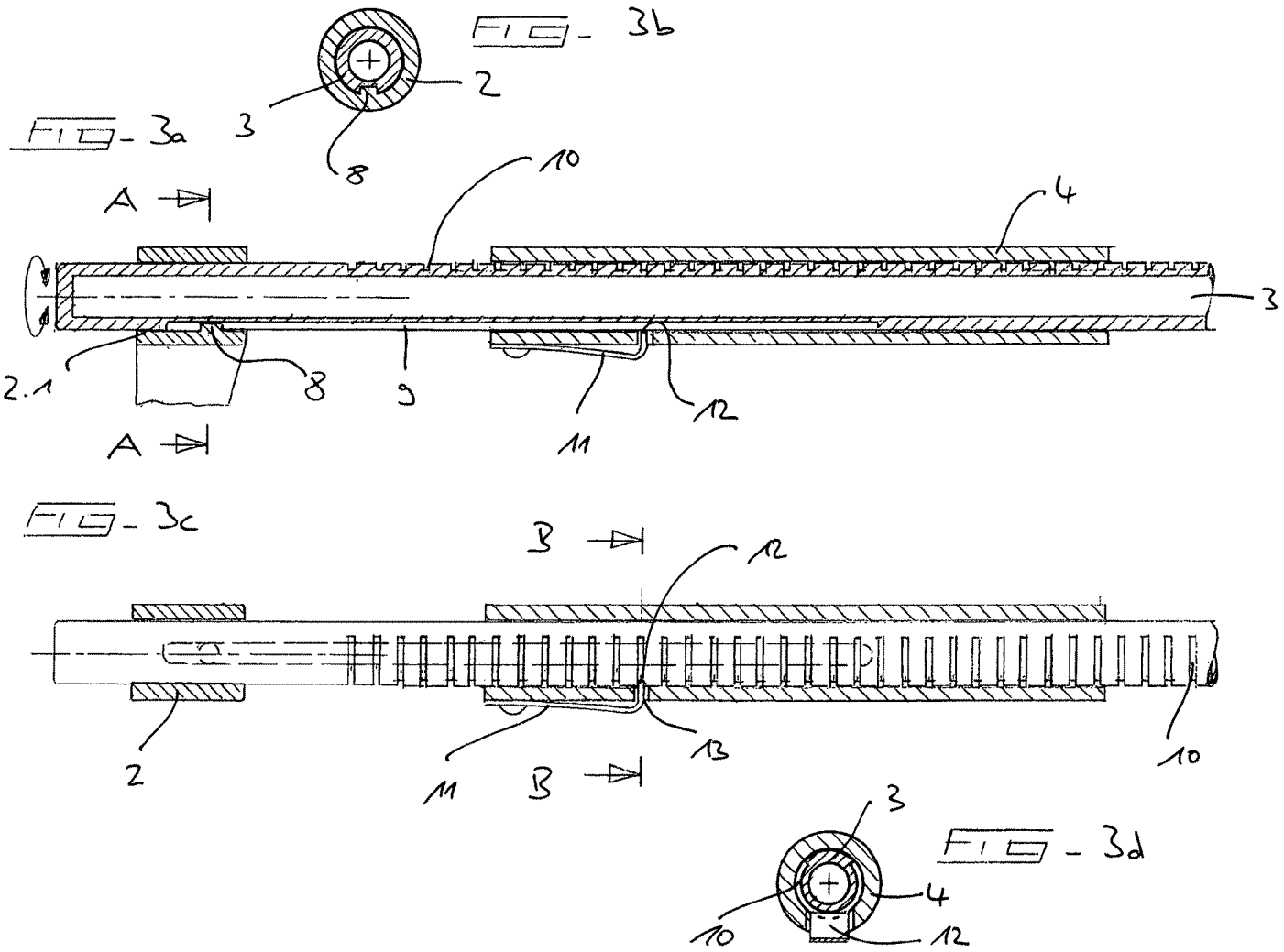
FIG. 3*a* a locking mechanism for a rod of the clamping device.
FIG. 3*b* a section along A-A from FIG. 3*a;*
FIG. 3*c* the locking mechanism in the latched state.
FIG. 3*d* a section along B-B from FIG. 3*c;*

The receiving device 2 has a stud 8 in the interior of the receiving bore 2.1, which is guided in a longitudinal groove 9 of the rod 3 (FIGS. 3*a*, 3*b*). In this manner, it is ensured that the receiving device 2 is displaceable relative to the rod 3 and cannot be removed from the rod 3 since the groove 9 is bounded at both ends in axial direction.

Moreover, the rod 3 has a series of radial slits 10, which are only provided over half of the circumference of the rod 3.

The longitudinal guide 4 has a spring element 11 acting radially inwards, which passes through a bore 13 in the longitudinal guide 4 with a nose 12 and can engage with the radial slits 10. Hereby, the axial position of the rod 3 is fixed (FIGS. 3*c*, 3*d*).

As is in particular apparent from FIGS. 3*a* to 3*d*, by simply rotating the rod 3, the end 12 can be brought out of engagement with a radial slit 10 such that the rod 3 is then again axially displaceable within the longitudinal guide 4. By corresponding rotation of the rod 3, it is then again possible that the spring element 11 locks in another radial slit 10 with its end 12 such that the rod 3 is latched in another axial position. For rotating the rod, the receiving device 2 can be operated by a user in the form of a lever.

Figure 4:
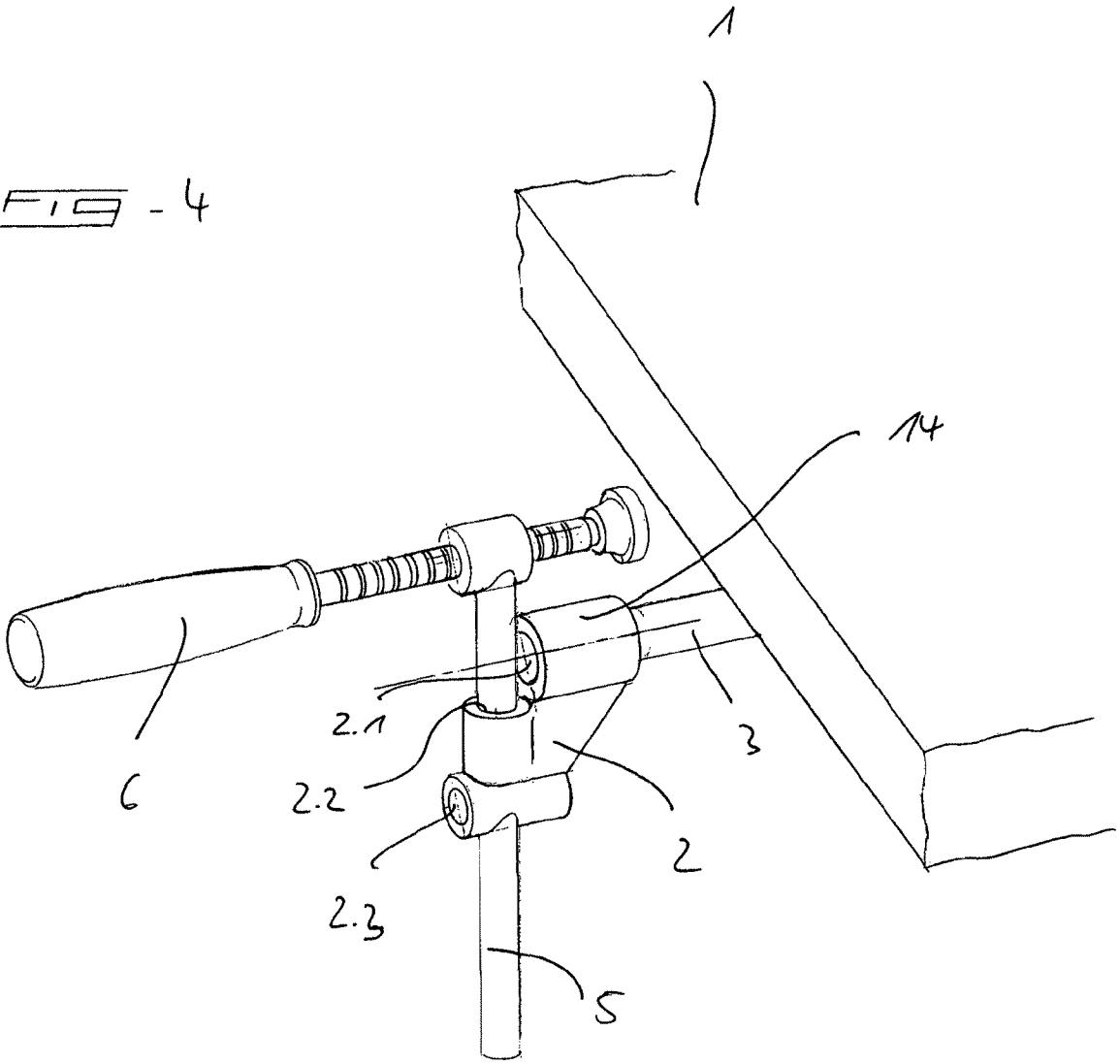
FIG. 4 a perspective view of the clamping device in a lateral clamping position.
Figure 5:
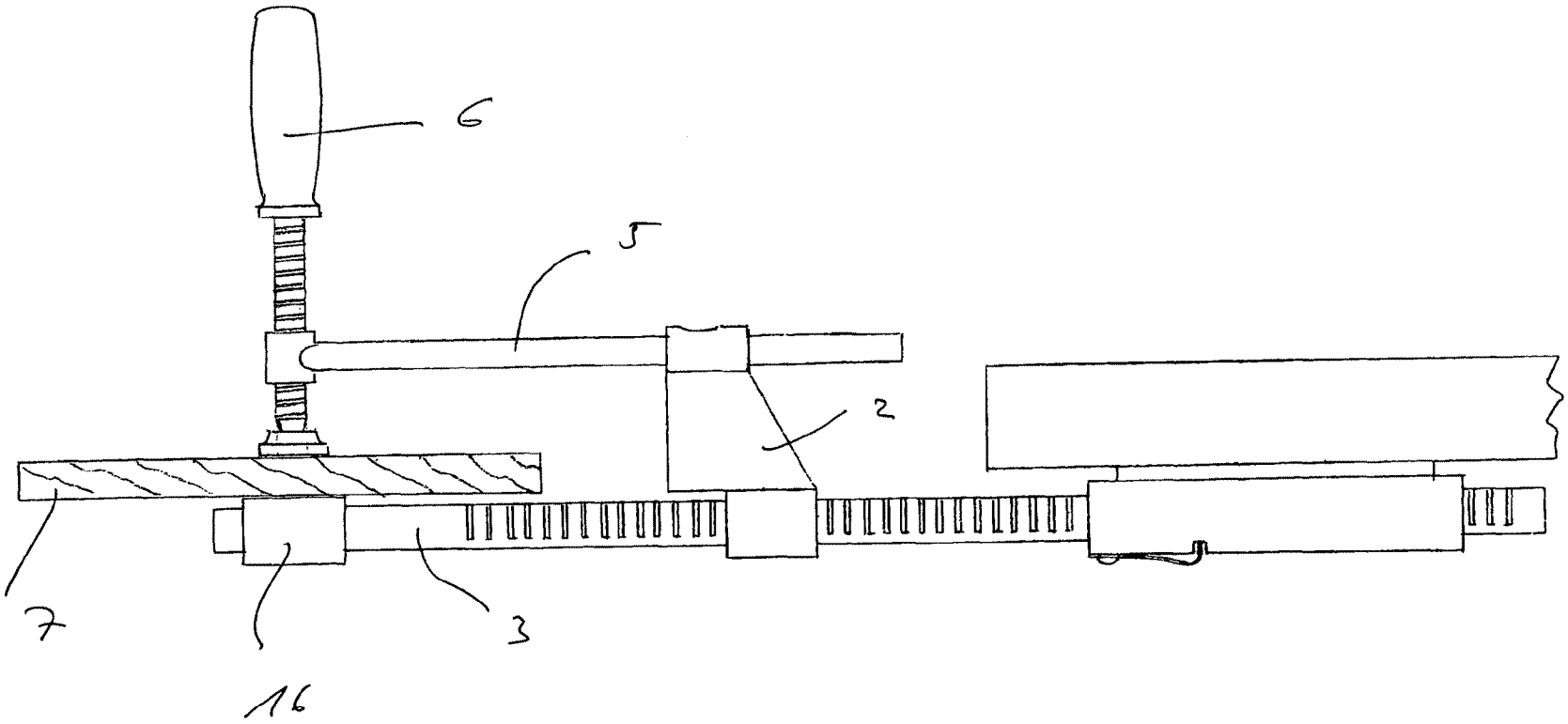
FIG. 5 a perspective view of a further clamping position of the clamping device.

As the difference between the FIGS. 4 and 5 shows, by simply rotating the receiving device 2 on the one hand and by a corresponding selection of the receiving bore for the guide rod 5 of the screw clamp, a different clamping position of the entire clamping device with respect to the processing table 1 can be realized.

By the use of the receiving bore 2.2, for example, a workpiece 7 can be clamped on the front side of the processing table 1 (FIGS. 1 and 4), wherein an area of the receiving device 2 can moreover serve as a supporting surface 14 for the workpiece 7 as FIG. 1 illustrates.

In an alternative application of the clamping device according to the invention, as it is exemplarily shown in FIG. 5, the guide rod 5 of the screw clamp is inserted into the receiving bore 2.3 from the outside, after the receiving device 2 has been correspondingly rotated upwards around the rod 3. Thereby, the clamping screw 6 is oriented away from the supporting surface 1 such that a workpiece 7 can be clamped in cantilevered manner. Herein, a fixture 16 is also fitted to the rod 3, which constitutes the abutment for the workpiece 7 in clamping. The workpiece 7 can then be processed in barrier-free manner, which is advantageous for sawing operations. In that more than one clamping device according to the invention can be provided on a supporting surface 1 in defined intervals, very extensive and very long workpieces can be stably clamped, respectively.

Figure 6:
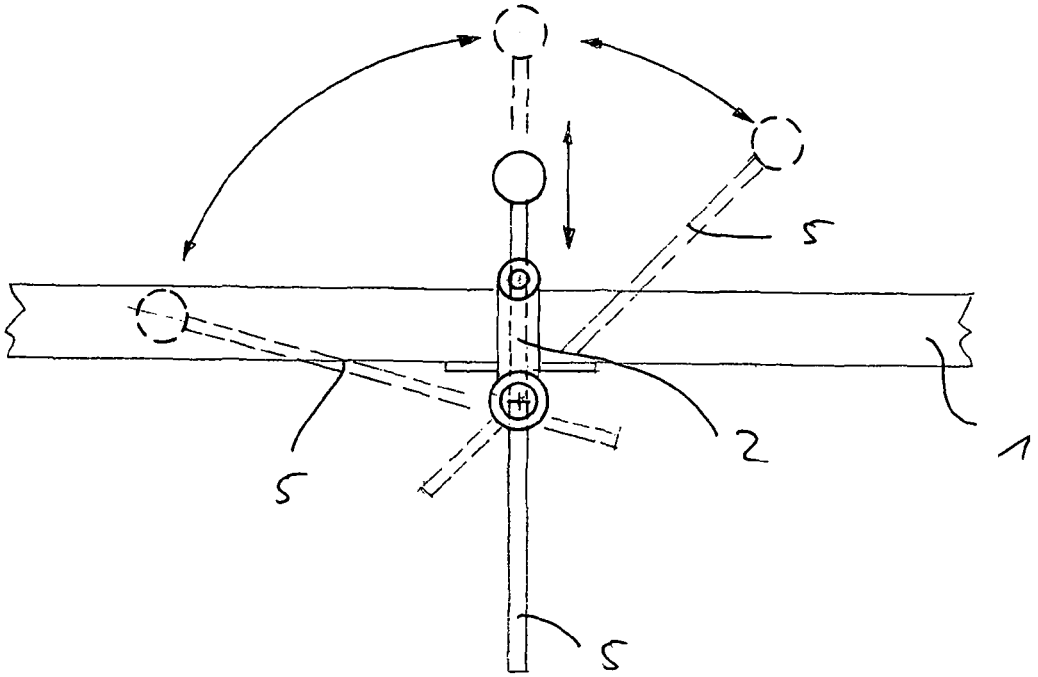
FIG. 6 a schematic view with respect to the different further degrees of freedom.

In FIG. 6, the further three degrees of freedom for the clamping device according to the invention are again illustrated.

Thus, due to the rotatable support of the receiving device 2 on the rod 3, a degree of freedom exists in the rotation plane of the rod 3. Moreover, the guide rod 5 can each be axially displaced within the receiving bore 2.2 or 2.3 to thus realize different elevations or transverse positions with respect to the processing table 1. A further degree of freedom is accomplished in that the guide rod 5 of the screw clamp itself is rotatable within the respective receiving bores 2.2 or 2.3 in its axis.

It becomes clear that by this very high variability with the four different degrees of freedom, workpieces in different dimensions and shapes each can be fixed to the processing table 1 in very different positions for performing diverse processing steps.

The high variability in the different directions of movement also allows that the clamping device overall can be stowed below the processing table 1 by correspondingly rotating the screw clamp on the one hand and by inserting the rod 3 on the other hand. Hereto, the longitudinal guide 4 also has a latching mechanism in the form of a receiving spring 15, with which the guide rod 5 engages when the overall device is completely inserted below the processing table 1.

The invention claimed is:

1. A clamping device for clamping a workpiece, comprising a clamping element for clamping the workpiece;

a rod having multiple radial slits disposed one behind the other in a longitudinal direction of the rod, which each only extend along a partial circumferential area of the rod;

a receiving device for receiving a clamping element and the rod;

a longitudinal guide, within which the rod is disposed rotatably between a latching position and a release position;

a locking mechanism disposed on the longitudinal guide, which does not engage with any of the radial slits in the release position such that the rod is movable in an axial direction within the longitudinal guide, and engages with at least one of the radial slits in the latching position such that the rod is fixed in the axial direction within the longitudinal guide.

2. A clamping device according to claim 1, wherein the receiving device has a first receiving bore, in which the rod is rotationally fixedly received.

3. A clamping device according to claim 2, wherein the rod is axially displaceably received in the first receiving bore.

4. A clamping device according to claim 2, wherein the receiving bore has a stud in the interior, which is guided in a longitudinal groove of the rod bounded at both ends.

5. A clamping device according to claim 2, wherein the receiving device has a second receiving bore, in which a guide rod of the clamping element is axially displaceably and rotatably receivable.

6. A clamping device according to claim 5, wherein the first receiving bore extends perpendicularly to the second receiving bore.

7. A clamping device according to claim 5, wherein the receiving device has a third receiving bore, in which the guide rod of the clamping element is axially displaceably and rotatably receivable.

8. A clamping device according to claim 7, wherein the first receiving bore extends parallel to the third receiving bore.

9. A clamping device according to claim 5, wherein the longitudinal guide has a latching mechanism, by means of which the guide rod is fixable to the longitudinal guide.

10. A clamping device according to claim 1, characterized in that the latching mechanism has a spring element acting radially inwards in a radial direction of the rod, which does not engage with any of the radial slits in the release position and engages with at least one of the radial slits in the latching position.

11. A clamping device according to claim 10, wherein the spring element has a nose, which passes through a bore in the longitudinal guide and does not engage with any of the radial slits in the release position and engages with at least one of the radial slits in the latching position.

12. A clamping device according to claim 1, wherein the clamping device has a fixture serving as an abutment for the workpiece, which can be disposed on the rod.

13. A clamping device according to claim 1, wherein the receiving device has at least one supporting surface for the workpiece.

14. A clamping device according to any one of the preceding claims, wherein the longitudinal guide is fixable to a processing table, in particular on a bottom of the processing table.

15. A processing table with a clamping device according to claim 1.

* * * * *